US009617491B2

(12) United States Patent
Kaneko et al.

(10) Patent No.: US 9,617,491 B2
(45) Date of Patent: Apr. 11, 2017

(54) COAL DEACTIVATION TREATMENT DEVICE

(71) Applicant: MITSUBISHI HEAVY INDUSTRIES, LTD., Tokyo (JP)

(72) Inventors: Takeshi Kaneko, Tokyo (JP); Keiichi Nakagawa, Tokyo (JP); Setsuo Omoto, Tokyo (JP); Keiichi Sato, Tokyo (JP); Junji Asahara, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 182 days.

(21) Appl. No.: 14/359,485

(22) PCT Filed: Dec. 21, 2012

(86) PCT No.: PCT/JP2012/083230
§ 371 (c)(1),
(2) Date: May 20, 2014

(87) PCT Pub. No.: WO2013/103096
PCT Pub. Date: Jul. 11, 2013

(65) Prior Publication Data

US 2014/0366433 A1 Dec. 18, 2014

(30) Foreign Application Priority Data

Jan. 6, 2012 (JP) ..... 2012-000940

(51) Int. Cl.
*C10L 9/00* (2006.01)
*C10L 5/26* (2006.01)
(Continued)

(52) U.S. Cl.
CPC *C10L 5/26* (2013.01); *A62C 3/06* (2013.01); *C10L 9/06* (2013.01); *C10L 9/08* (2013.01);
(Continued)

(58) Field of Classification Search
CPC ..... C10L 2290/145; C10L 2290/20; C10L 2290/58; C10L 2290/60
(Continued)

(56) References Cited

U.S. PATENT DOCUMENTS 3,723,079 A 3/1973 Seitzer
4,249,909 A 2/1981 Comolli
(Continued)

FOREIGN PATENT DOCUMENTS

AU 2011342432 B2 6/2012
CN 1039052 A 1/1990
(Continued)

OTHER PUBLICATIONS

Japanese Notice of Allowance dated Dec. 10, 2014, issued in corresponding Japanese Application No. 2012-000940; w/ English translation.(6 pages).
(Continued)

*Primary Examiner* — Ellen McAvoy
(74) *Attorney, Agent, or Firm* — Westerman, Hattori, Daniels & Adrian, LLP

(57) ABSTRACT

A coal deactivation treatment device for deactivating of coal by means of a treatment gas that is a mixture of air and nitrogen gas is provided with, among other things: a treatment column inside of which coal flows from the top to the bottom; treatment gas feed means, and the like, for feeding treatment gas to the inside of the treatment column; humidifying heaters for heating and humidifying the treatment gas such that the treatment gas fed to the inside of the treatment column can maintain a relative humidity of 35% or greater, even at 95° C.; a temperature sensor and a control device for adjusting the temperature inside the treatment column such
(Continued)

that the inside of the treatment column is maintained at a relative humidity of 35% or greater and a temperature of 95° C. or lower.

7 Claims, 3 Drawing Sheets

(51) Int. Cl.
*A62C 3/06* (2006.01)
*C10L 9/06* (2006.01)
*C10L 9/08* (2006.01)

(52) U.S. Cl.
CPC ..... *C10L 2290/00* (2013.01); *C10L 2290/145* (2013.01); *C10L 2290/58* (2013.01); *C10L 2290/60* (2013.01)

(58) Field of Classification Search
USPC ..... 44/620, 629
See application file for complete search history.

(56) References Cited

U.S. PATENT DOCUMENTS

| | | | | |
|---|---|---|---|---|
| 4,402,706 | A | 9/1983 | Wunderlich | |
| 4,797,136 | A | 1/1989 | Siddoway et al. | |
| 4,828,576 | A | 5/1989 | Bixel et al. | |
| 5,035,721 | A | 7/1991 | Atherton | |
| 5,137,539 | A | 8/1992 | Bowling | |
| 5,290,523 | A | 3/1994 | Koppelman | |
| 5,324,336 | A | 6/1994 | Child | |
| 5,711,769 | A | 1/1998 | Rinker et al. | |
| 5,746,787 | A * | 5/1998 | Koppelman | C10L 9/06 422/201 |
| 5,840,651 | A | 11/1998 | Hanashita et al. | |
| 5,863,304 | A * | 1/1999 | Viall | C10L 9/06 44/620 |
| 6,090,171 | A | 7/2000 | Viall et al. | |
| 6,146,432 | A * | 11/2000 | Ochs | C10L 5/00 44/501 |
| 6,436,158 | B1 * | 8/2002 | Fujikawa | C10L 9/06 44/592 |
| 6,878,174 | B1 | 4/2005 | Conochie | |
| 8,671,586 | B2 * | 3/2014 | Bonner | C10L 5/04 110/229 |
| 8,951,311 | B2 * | 2/2015 | Rozelle | C10J 3/50 34/384 |
| 9,290,711 | B2 * | 3/2016 | Sato | C10B 57/08 |
| 9,464,245 | B2 | 10/2016 | Gao et al. | |
| 2011/0059410 | A1 | 3/2011 | Glynn | |
| 2011/0126743 | A1 * | 6/2011 | Takase | C10J 3/466 110/232 |
| 2014/0345193 | A1 * | 11/2014 | Nakagawa | C10L 9/06 44/596 |
| 2014/0366433 | A1 | 12/2014 | Kaneko et al. | |
| 2014/0373436 | A1 * | 12/2014 | Nakagawa | C10B 47/30 44/629 |
| 2015/0210945 | A1 * | 7/2015 | Nakagawa | C10L 9/06 44/629 |
| 2015/0329793 | A1 * | 11/2015 | Kaneko | C10L 9/06 44/629 |
| 2015/0376531 | A1 * | 12/2015 | Atarashiya | C10L 9/06 44/629 |

FOREIGN PATENT DOCUMENTS

| | | | |
|---|---|---|---|
| CN | 1010482 | B | 11/1990 |
| CN | 1597283 | A | 3/2005 |
| CN | 101429463 | A | 5/2009 |
| CN | 101781596 | A | 7/2010 |
| CN | 103180418 | A | 6/2013 |
| DE | 44 98 936 | T1 | 12/1995 |
| EP | 0 758 677 | A1 | 2/1997 |
| GB | 1423187 | A | 1/1976 |
| JP | 59-74189 | A | 4/1984 |
| JP | 59-227979 | A | 12/1984 |
| JP | 6065097 | A | 4/1985 |
| JP | 9-71791 | A | 3/1997 |
| JP | 11-310785 | A | 11/1999 |
| JP | 3669373 | B2 | 7/2005 |
| JP | 2007-237011 | A | 9/2007 |
| JP | 2007-536392 | A | 12/2007 |
| JP | 2010-265394 | A | 11/2010 |
| JP | 201137938 | A | 2/2011 |
| JP | 2012-126856 | A | 7/2012 |
| JP | 2013-139536 | A | 7/2013 |
| WO | 95/13868 | A1 | 5/1995 |
| WO | 2011/016371 | A1 | 2/2011 |
| WO | 2012/058851 | A1 | 5/2012 |
| WO | 2012/081371 | A1 | 6/2012 |
| WO | 2012/083230 | A1 | 6/2012 |
| WO | 2013/103096 | A1 | 7/2013 |

OTHER PUBLICATIONS

Notification of Transmittal of translation of the International Preliminary Report of the International Preliminary Report on Patentability (Chapter I or Chapter I I) (Form PCT/IB/338) of the International Application No. PCT/JP2012/083230 mailed Jul. 17, 2014 with forms PCT/IB/373 and PCT/ISA/237.

Notification of Transmital of translation of the International Preliminary Report of the International Preliminary Report on Patentability (Chapter I or ChapterII) (Form PCT/IB/338) of the International Application No. PCT/JP2012/083230 mailed Jul. 17, 2014 with forms PCT/IB/373 and PCT/ISA/237.

Chinese Office Action dated Nov. 21, 2014, issued in corresponding Chinese Patent Application No. 201280056170.0, w/English translation (10 pages).

Office Action dated Feb. 12, 2016, issued in counterpart German Patent Application No. 11 2012 005 574.8, with English translation. (10 pages).

International Search Report dated Nov. 5, 2013, issued in corresponding application No. PCT/JP2013/076477, with forms PCT/IB/338, PCT/IB/373 and PCT/ISA/237, w/English translations.(17 pages).

International Search Report dated Mar. 11, 2014, issued in corresponding application No. PCT/JP2014/050894, with forms PCT/IB/373 and PCT/ISA/237, w/English translations. (8 pages).

Office Action dated Jul. 4, 2016, issued in Chinese Application 201480011537.6, with English translation. (21 pages).

Non-Final Office Action dated Oct. 26, 2016, issued in U.S. Appl. No. 14/769,942 (31 pages).

Non-Final Office Action dated Feb. 9, 2017 issued in related U.S. Appl. No. 14/408,784 (21 pages).

Final Office Action dated Feb. 1, 2017, issued in related U.S. Appl. No. 14/769,942 (13 pages).

* cited by examiner

COAL DEACTIVATION TREATMENT DEVICE

TECHNICAL FIELD

The present invention relates to a coal deactivation processing apparatus configured to deactivate coal with processing gas containing oxygen.

BACKGROUND ART

Dry-distilled coal has an activated surface, which tends to bond with oxygen. Accordingly, when the coal is stored as it is, heat generated by reaction with oxygen in air may cause the coal to spontaneously combust. In view of this, oxygen is first bonded to the surface of the dry-distilled coal by exposing the coal to a processing gas atmosphere containing oxygen and the coal is thereby deactivated. The spontaneous combustion in storage is thus prevented.

CITATION LIST

Patent Literatures

Patent Literature 1: Japanese Patent Application Publication No. 2007-237011

Patent Literature 2: Pamphlet of International Patent Application Publication No. 95/13868

SUMMARY OF INVENTION

Technical Problem

When the coal is deactivated as described above, in an initial stage of the deactivation, the coal tends to rapidly react. The coal may thus increase in temperature and spontaneously combust.

In view of this, an object of the present invention is to provide a coal deactivation processing apparatus capable of suppressing a temperature increase of coal being processed.

Solution to Problem

A coal deactivation processing apparatus of a first aspect of the invention to solve the problem described above is a coal deactivation processing apparatus configured to deactivate coal with processing gas containing oxygen, characterized in that the coal deactivation processing apparatus comprises: an apparatus main body in which the coal flows from one side to another side; processing gas feeding means for feeding the processing gas into the apparatus main body; processing gas humidifying heating means for heating and humidifying the processing gas to be fed into the apparatus main body in such a way that a relative humidity of the processing gas is maintainable to be 35% or more even when a temperature of the processing gas is 95° C.; and apparatus main body internal-environment adjusting means for adjusting a temperature inside the apparatus main body in such away that the relative humidity inside the apparatus main body is 35% or more and a temperature inside the apparatus main body is 95° C. or less.

A coal deactivation processing apparatus of a second aspect of the invention is the coal deactivation processing apparatus of the first aspect of the invention characterized in that the apparatus main body internal-environment adjusting means includes: apparatus main body internal-temperature measuring means for measuring the temperature inside the apparatus main body; processing gas oxygen concentration adjusting means for adjusting an oxygen concentration of the processing gas to be fed into the apparatus main body; and control means for controlling the processing gas oxygen concentration adjusting means on the basis of information from the apparatus main body internal-temperature measuring means.

A coal deactivation processing apparatus of a third aspect of the invention is the coal deactivation processing apparatus of the second aspect of the invention characterized in that the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the processing gas oxygen concentration adjusting means includes one-side oxygen concentration adjusting means for adjusting the oxygen concentration of the processing gas to be fed into the one side of the apparatus main body, and the control means controls the one-side oxygen concentration adjusting means on the basis of information from the one-side temperature measuring means.

A coal deactivation processing apparatus of a fourth aspect of the invention is the coal deactivation processing apparatus of the first aspect of the invention characterized in that the apparatus main body internal-environment adjusting means includes: apparatus main body internal-temperature measuring means for measuring the temperature inside the apparatus main body; processing gas flow-rate adjusting means for adjusting a flow rate of the processing gas to be fed into the apparatus main body; and control means for controlling the processing gas flow-rate adjusting means on the basis of information from the apparatus main body internal-temperature measuring means.

A coal deactivation processing apparatus of a fifth aspect of the invention is the coal deactivation processing apparatus of the fourth aspect of the invention characterized in that the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the processing gas flow-rate adjusting means includes one-side gas flow-rate adjusting means for adjusting the flow-rate of the processing gas to be fed into the one side of the apparatus main body, and the control means controls the one-side gas flow-rate adjusting means on the basis of information from the one-side temperature measuring means.

A coal deactivation processing apparatus of a sixth aspect of the invention is the coal deactivation processing apparatus of the first aspect of the invention characterized in that the apparatus main body internal-environment adjusting means includes: apparatus main body internal-temperature measuring means for measuring the temperature inside the apparatus main body; cooling water flow means for causing cooling water to flow inside the apparatus main body; and control means for controlling the cooling water flow means on the basis of information from the apparatus main body internal-temperature measuring means.

A coal deactivation processing apparatus of a seventh aspect of the invention is the coal deactivation processing apparatus of the sixth aspect of the invention characterized in that the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the cooling water flow means includes one-side flow means for causing the cooling water to flow inside the apparatus main body on the one side, and the control means controls the one-side flow means on the basis of information from the one-side temperature measuring means.

Advantageous Effects of Invention

In the coal deactivation processing apparatus of the present invention, the processing gas humidifying heating means heats and humidifies the processing gas to be fed into the apparatus main body in such a way that the relative humidity of the processing gas is maintainable to be 35% or more even when the temperature of the processing gas is 95° C., and the apparatus main body internal-environment adjusting means adjusts the temperature inside the apparatus main body in such a way that the relative humidity inside the apparatus main body is 35% or more and the temperature inside the apparatus main body is 95° C. or less. Accordingly, it is possible to always maintain the inside of the processing tower at a temperature of 95° C. or less and at a relative humidity of 35% or more and suppress a temperature increase of coal being processed.

DESCRIPTION OF EMBODIMENTS

Embodiments of a coal deactivation processing apparatus of the present invention are described below based on the drawings. However, the present invention is not limited to the embodiments described below based on the drawings.

<First Embodiment>

Figure 1:
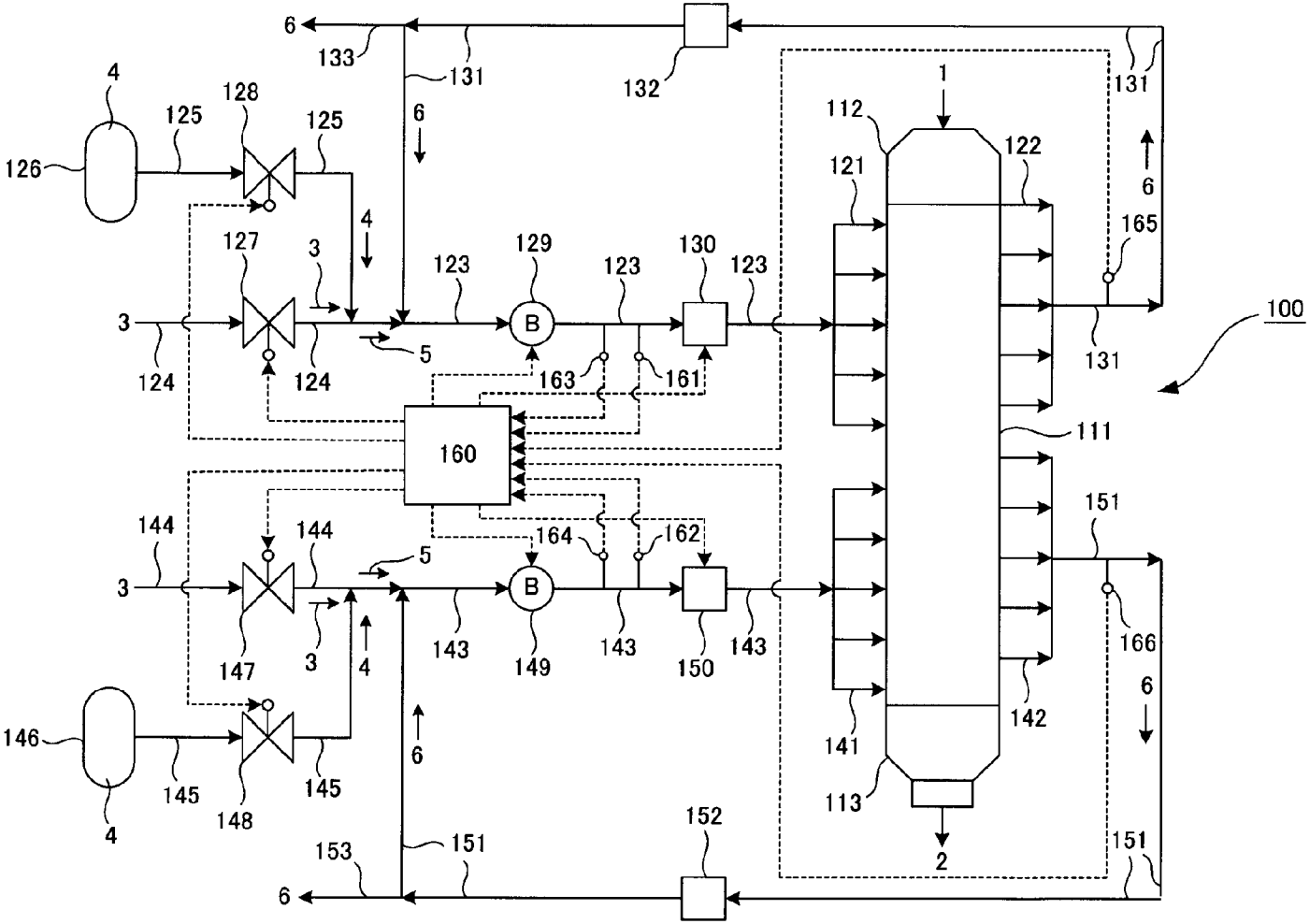
FIG. 1 is a schematic configuration diagram of a first embodiment of a coal deactivation processing apparatus of the present invention.

A first embodiment of the coal deactivation processing apparatus of the present invention is described based on FIG. 1.

As shown in FIG. 1, on a processing tower 111 in which dry-distilled coal 1 flows from an upper side being one side to a lower side being another side, there is provided a supply chamber 112 configured to supply the coal 1 into the processing tower 111. Below the processing tower 111, there is provided a cooling chamber 113 which receives a processed coal 2 having flowed inside the processing tower 111 and which discharges the processed coal 2 after cooling it.

A set of front end sides of multiple introduction pipes 121 and a set of base end sides of multiple exhaust pipes 122 are each connected to a portion of the processing tower 111 above (on one side of) the middle thereof in a manner arranged in an up-down direction, the introduction pipes 121 configured to introduce processing gas 5 containing oxygen into the portion of the processing tower 111 above the middle thereof, the exhaust pipes 122 configured to exhaust the processing gas 5 having flowed inside the portion of the processing tower 111 above the middle thereof to the outside.

A front end side of a feed pipe 123 configured to feed the processing gas 5 is connected to base end sides of the introduction pipes 121. A front end side of an air supply pipe 124 configured to supply air 3 and a front end side of a nitrogen supply pipe 125 configured to supply nitrogen gas 4 are connected to a base end side of the feed pipe 123. Abase end side of the nitrogen supply pipe 125 is connected to a nitrogen supply source 126 such as a nitrogen gas tank. A base end side of the air supply pipe 124 is opened to the atmosphere.

A flow-rate adjustment valve 127 is provided in the middle of the air supply pipe 124 while a flow-rate adjustment valve 128 is provided in the middle of the nitrogen supply pipe 125. A blower 129 is provided in the middle of the feed pipe 123. A humidifying heating device 130 which is one-side humidifying heating means for heating and humidifying the processing gas 5 is provided between the front end side of the feed pipe 123 and the blower 129.

Front end sides of the exhaust pipes 122 are connected to a base end side of a circulation pipe 131. A front end side of the circulation pipe 131 is connected to a portion between the base end side of the feed pipe 123 and the blower 129. A dust removing device 132 such as a cyclone which removes dust in gas is provided in the middle of the circulation pipe 131. A base end side of an emission pipe 133 is connected to a portion between the front end side of the circulation pipe 131 and the dust removing device 132. A front end side of the emission pipe 133 communicates with the outside via a not-illustrated scrubber or the like.

Moreover, a set of front end sides of multiple introduction pipes 141 and a set of base end sides of multiple exhaust pipes 142 are each connected to a portion of the processing tower 111 below (on another side of) the middle thereof in a manner arranged in the up-down direction, the introduction pipes 141 configured to feed the processing gas 5 into the portion of the processing tower 111 below the middle thereof, the exhaust pipes 142 configured to exhaust the processing gas 5 having flowed inside the portion of the processing tower 111 below the middle thereof to the outside.

A front end side of a feed pipe 143 configured to feed the processing gas 5 is connected to base end sides of the introduction pipes 141. A front end side of an air supply pipe 144 configured to supply the air 3 and a front end side of a nitrogen supply pipe 145 configured to supply the nitrogen gas 4 are connected to a base end side of the feed pipe 143. A base end side of the nitrogen supply pipe 145 is connected to a nitrogen supply source 146 such as a nitrogen gas tank. A base end side of the air supply pipe 144 is opened to the atmosphere.

A flow-rate adjustment valve 147 is provided in the middle of the air supply pipe 144 while a flow-rate adjustment valve 148 is provided in the middle of the nitrogen supply pipe 145. A blower 149 is provided in the middle of the feed pipe 143. A humidifying heating device 150 which is other-side humidifying heating means for heating and humidifying the processing gas 5 is provided between the front end side of the feed pipe 143 and the blower 149.

Front end sides of the exhaust pipes 142 are connected to a base end side of a circulation pipe 151. A front end side of the circulation pipe 151 is connected to a portion between the base end side of the feed pipe 143 and the blower 149. A dust removing device 152 such as a cyclone which removes dust in gas is provided in the middle of the circulation pipe 151. A base end side of an emission pipe 153 is connected to a portion between the front end side of the circulation pipe 151 and the dust removing device 152. A front end side of the emission pipe 153 communicates with the outside via a not-illustrated scrubber or the like.

Oxygen sensors 161, 162 configured to measure oxygen concentrations in gases flowing in the feed pipes 123, 143 and flow meters 163, 164 configured to measure flow rates of the gases flowing in the feed pipes 123, 143 are provided respectively in the feed pipes 123, 143 between the blower 129 and the humidifying heating device 130 and between the blower 149 and the humidifying heating device 150. A temperature sensor 165 being one-side temperature measuring means and a temperature sensor 166 being other-side temperature measuring means which measure the temperature of used processing gas 6 exhausted from the processing tower 111, i.e. the temperatures inside the processing tower 111 are provided respectively on the base end sides of the circulation pipes 131, 151.

The sensors 161, 162, 165, 166 and the flowmeters 163, 164 are electrically connected to an input unit of a control device 160 which is control means. An output unit of the control device 160 is electrically connected to the flow-rate adjustment valves 127, 128, 147, 148, the blowers 129, 149, and the humidifying heating device 130, 150. The control device 160 can control operations of the flow-rate adjustment valves 127, 128, 147, 148, the blowers 129, 149, and the humidifying heating device 130, 150 on the basis of information from the sensors 161, 162, 165, 166, the flow meters 163, 164, and the like (details will be described later).

Note that, in the embodiment, an apparatus main body is formed of the processing tower 111, the supply chamber 112, the cooling chamber 113, and the like; one-side feeding means is formed of the introduction pipes 121, the exhaust pipes 122, the feed pipe 123, the air supply pipe 124, the nitrogen supply pipe 125, the nitrogen supply source 126, the flow-rate adjustment valves 127, 128, the blower 129, the circulation pipe 131, the emission pipe 133, and the like; other-side feeding means is formed of the introduction pipes 141, the exhaust pipes 142, the feed pipe 143, the air supply pipe 144, the nitrogen supply pipe 145, the nitrogen supply source 146, the flow-rate adjustment valves 147, 148, the blower 149, the circulation pipe 151, the emission pipe 153, and the like; processing gas feeding means is formed of the one-side feeding means, the other-side feeding means, and the like; the processing gas humidifying heating means is formed of the humidifying heating device 130, 150 and the like; apparatus main body internal-temperature measuring means is formed of the temperature sensors 165, 166 and the like; one-side oxygen concentration adjusting means is formed of the flow-rate adjustment valves 127, 128 and the like; one-side gas flow-rate adjusting means is formed of the flow-rate adjustment valves 127, 128, the blower 129, and the like; other-side oxygen concentration adjusting means is formed of the flow-rate adjustment valves 147, 148 and the like; the other-side gas flow-rate adjusting means is formed of the flow-rate adjustment valves 147, 148, the blower 149, and the like; processing gas oxygen concentration adjusting means is formed of the one-side oxygen concentration adjusting means, the other-side oxygen concentration adjusting means, and the like; processing gas flow-rate adjusting means is formed of the one-side gas flow-rate adjusting means, the other-side gas flow-rate adjusting means, and the like; and apparatus main body internal-environment adjusting means is formed of the apparatus main body internal-temperature measuring means, the processing gas oxygen concentration adjusting means, the control device 160, and the like.

Next, operations of a coal deactivation processing apparatus 100 of such an embodiment are described.

When the dry-distilled coal 1 is supplied from the supply chamber 112 into the processing tower 111 and the control device 160 is made to operate, in order to achieve a predetermined oxygen concentration (for example, 5 to 10 vol. %) and a predetermined flow rate, the control device 160 first controls opening degrees of the flow-rate adjustment valves 127, 128, 147, 148 and operations of the blowers 129, 149 on the basis of information from the oxygen sensors 161, 162 and the flow meters 163, 164, and the air 3 and the nitrogen gas 4 are thereby fed from the supply pipes 124, 125, 144, 145 to the feed pipes 123, 143 and mixed with each other to obtain the processing gas 5. The control device 160 also controls operations of the humidifying heating devices 130, 150 to heat and humidify (for example, saturated state at 50° C.) the processing gas 5 in such a way that a relative humidity of the processing gas is maintainable to be 35% or more even when the temperature of the processing gas 5 is 95° C.

The processing gas 5 humidified and heated as described above is introduced from the introduction pipes 121, 141 respectively into the upper and lower portions of the processing tower 111, deactivates a surface of the coal 1 inside the processing tower 111, and is then exhausted from the exhaust pipes 122, 142 to the circulation pipes 131, 151 as the used processing gas 6.

The dust removing devices 132, 152 remove dust from the used processing gas 6 (nitrogen gas in which oxygen gas is almost consumed) exhausted to the circulation pipes 131, 151. Part of the used processing gas 6 is emitted from the emission pipes 133, 153 to the outside via the scrubber while a remaining portion thereof is returned to the feed pipes 123, 143, mixed with the new air 3 and the new nitrogen gas 4 from the supply pipes 124, 125, 144, 145, and used again as the new processing gas 5.

Meanwhile, the coal 2 whose surface is deactivated inside the processing tower 111 is cooled in the cooling chamber 113 and is then discharged to the outside.

When an amount of reaction between the coal 1 and oxygen in the processing gas 5 per unit time is large and the temperature inside the processing tower 111 exceeds 95° C. in the aforementioned deactivation processing of the surface of the coal 1, the control device 160 controls the opening degrees of the flow-rate adjustment valves 127, 128, 147, 148 on the basis of information from the sensors 161, 162, 165, 166 and the flow meters 163, 164 in such a way that the temperature inside the processing tower 111 becomes 95° C. or less with the processing gas 5 fed at a fixed flow rate. The control device 160 thereby causes the oxygen concentration in the processing gas 5 to decrease and suppresses the amount of reaction between the coal 1 and the oxygen in the processing gas 5 per unit time.

The inside of the processing tower 111 is thus always maintained at a temperature of 95° C. or less and at a relative humidity of 35% or more.

Accordingly, the coal deactivation processing apparatus 100 of the embodiment can suppress a temperature increase of the coal 1 being processed.

Moreover, the temperatures inside the upper and lower portions of the processing tower 111 can beindependently adjusted. Hence, even when there is a difference in temperature increase between the upper and lower portions of the processing tower 111, it is possible to adjust the temperature inside the processing tower 111 depending on the difference and eliminate wasteful energy consumption.

Incidentally, the amount of reaction between the coal 1 and the oxygen in the processing gas 5 per unit time becomes large mostly when the coal 1 is first supplied into the processing tower 111. Moreover, the case where the amount of reaction is large is likely to occur in an upper 30% to 70% (50±20%) portion of the processing tower 111, and does not occur often in a lower 30% to 70% (50±20%) portion of the processing tower 111.

In view of this, in the coal deactivation processing apparatus 100 of the embodiment, the initial cost and the running cost can be reduced by, for example, omitting the nitrogen supply pipe 145, the nitrogen supply source 146, the flow-rate adjustment valve 148, the oxygen sensor 162, and the like and supplying only the air 3 as the processing gas 5 into the portion of the processing tower 111 below the middle thereof.

<Second Embodiment>

Figure 2:
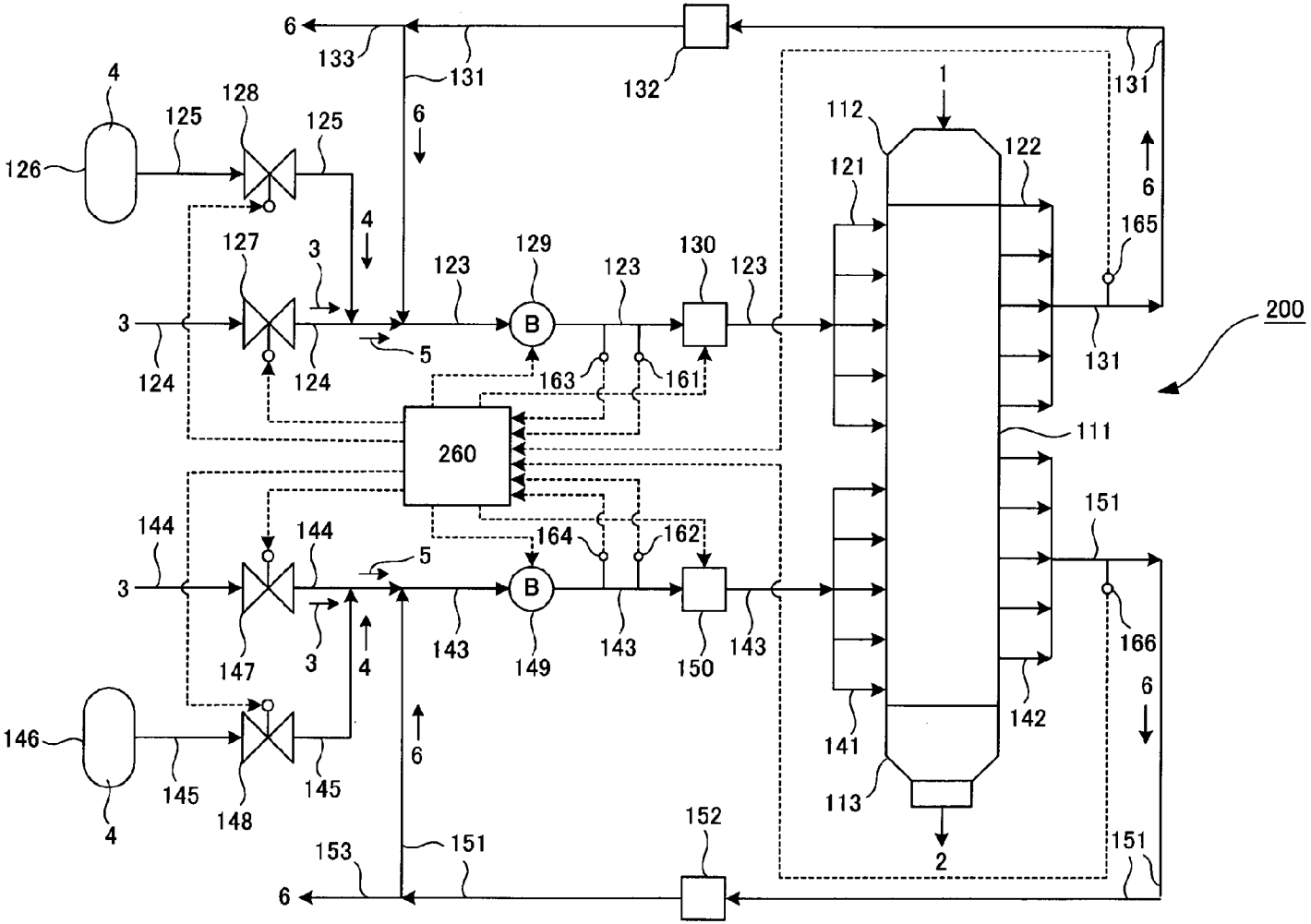
FIG. 2 is a schematic configuration diagram of a second embodiment of a coal deactivation processing apparatus of the present invention.

A second embodiment of a coal deactivation processing apparatus of the present invention is described based on FIG. 2. Note that the same parts as those of the aforementioned embodiment are denoted by the same reference numerals as those used in the description of the aforementioned embodiment and description overlapping the description of the aforementioned embodiment is omitted.

As shown in FIG. 2, the sensors 161, 162, 165, 166 and the flow meters 163, 164 are electrically connected to an input unit of a control device 260 which is control means. An output unit of the control device 260 is electrically connected to the flow-rate adjustment valves 127, 128, 147, 148, the blowers 129, 149, and the humidifying heating device 130, 150. The control device 260 can control operations of the flow-rate adjustment valves 127, 128, 147, 148, the blowers 129, 149, and the humidifying heating device 130, 150 on the basis of information from the sensors 161, 162, 165, 166, the flow meters 163, 164, and the like (details will described later).

Note that, in the embodiment, the apparatus main body internal-environment adjusting means is formed of the apparatus main body internal-temperature measuring means, the processing gas flow-rate adjusting means, the control device 260, and the like.

In a coal deactivation processing apparatus 200 of such an embodiment, when the control device 260 is made to operate, the control device 260 operates in a similar way to the control device 160 in the coal deactivation processing apparatus 100 of the aforementioned embodiment and performs deactivation processing of the surface of the coal 1 in the processing tower 111.

Then, when the amount of reaction between the coal 1 and the oxygen in the processing gas 5 per unit time is large and the temperature inside the processing tower 111 exceeds 95° C., the control device 260 controls the opening degrees of the flow-rate adjustment valves 127, 128, 147, 148 and blowing powers of the blowers 129, 149 on the basis of information from the sensors 161, 162, 165, 166 and the flow meters 163, 164 in such a way that the temperature inside the processing tower 111 becomes 95° C. or less with the processing gas 5 fed at a fixed oxygen concentration. The control device 260 thereby causes the flow rate of the processing gas 5 to increase and cools the inside of the processing tower 111 by using a wind.

In other words, although, in the aforementioned first embodiment, the temperature increase in the processing tower 111 is suppressed by reducing the oxygen concentration in the processing gas 5 to suppress the amount of reaction between the coal 1 and the oxygen, in the embodiment, the temperature increase in the processing tower 111 is suppressed by increasing the flow rate of the processing gas 5 to cool the inside of the processing tower 111 with a wind.

The inside of the processing tower 111 is thus always maintained at a temperature of 95° C. or less and at a relative humidity of 35% or more.

Accordingly, in the coal deactivation processing apparatus 200 of the embodiment, effects similar to those in the aforementioned embodiments can be obtained.

Note that, also in the coal deactivation processing apparatus 200 of the embodiment, as described in the aforementioned embodiment, the initial cost and the running cost can be reduced by, for example, omitting the nitrogen supply pipe 145, the nitrogen supply source 146, the flow-rate adjustment valve 148, the oxygen sensor 162, and the like and supplying only the air 3 as the processing gas 5 into the portion of the processing tower 111 below the middle thereof at a fixed flow-rate.

<Third Embodiment>

Figure 3:
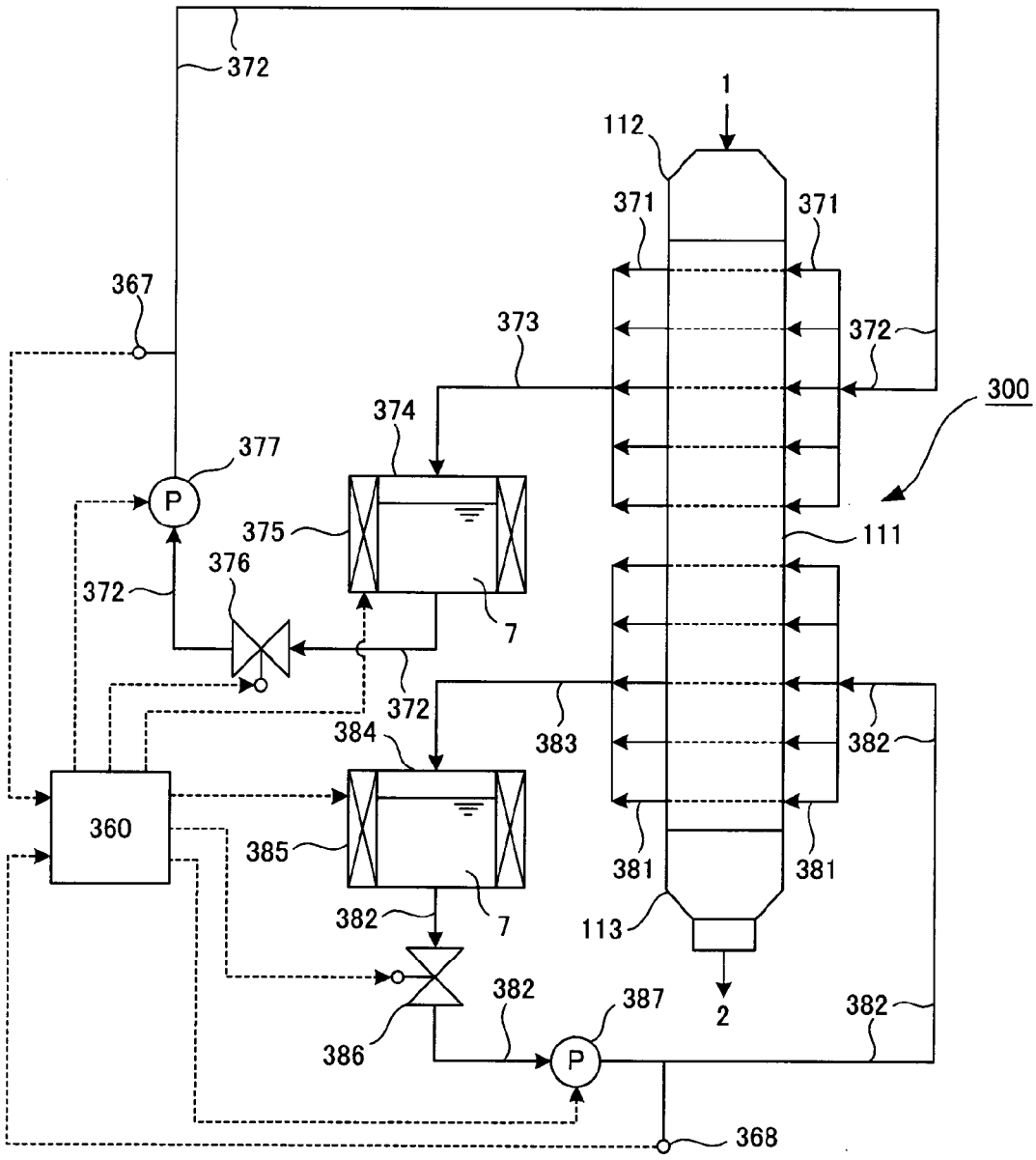
FIG. 3 is a schematic configuration diagram of a third embodiment of a coal deactivation processing apparatus of the present invention.

A third embodiment of a coal deactivation processing apparatus of the present invention is described based on FIG. 3. Note that the same parts as those of the aforementioned embodiment are denoted by the same reference numerals as those used in the description of the aforementioned embodiments and description overlapping the description of the aforementioned embodiments is omitted.

As shown in FIG. 3, multiple cooling pipes 371 through which cooling water 7 flows are provided in the portion of the processing tower 111 above (on the one side of) the middle thereof while being arranged in the up-down direction at predetermined intervals. Base end sides of the cooling pipes 371 are connected to a front end side of a feed pipe 372 configured to feed the cooling water 7. A base end side of the feed pipe 372 is connected to a bottom portion of a cooling water tank 374 configured to store the cooling water 7.

A temperature controller 375 configured to control the temperature of the cooling water 7 in the cooling water tank 374 is provided in the cooling water tank 374. A flow-rate adjustment valve 376 and a feed pump 377 are provided in the middle of the feed pipe 372. Front end sides of the cooling pipes 371 are connected to a base end side of a circulation pipe 373. A front end side of the circulation pipe 373 communicates with an upper portion of the cooling water tank 374. A flow meter 367 configured to measure the flow rate of the cooling water 7 is provided between the front end side of the feed pipe 372 and the feed pump 377.

Moreover, multiple cooling pipes 381 through which the cooling water 7 flows are provided in the portion of the processing tower 111 below (on the other side of) the middle thereof while being arranged in the up-down direction at predetermined intervals. Base end sides of the cooling pipes 381 are connected to a front end side of a feed pipe 382 configured to feed the cooling water 7. A base end side of the feed pipe 382 is connected to a bottom portion of a cooling water tank 384 configured to store the cooling water 7.

A temperature controller 385 configured to control the temperature of the cooling water 7 in the cooling water tank 384 is provided in the cooling water tank 384. A flow-rate adjustment valve 386 and a feed pump 387 are provided in the middle of the feed pipe 382. Front end sides of the cooling pipes 381 are connected to a base end side of a circulation pipe 383. A front end side of the circulation pipe 383 communicates with an upper portion of the cooling water tank 384. A flow meter 368 configured to measure the flow rate of the cooling water 7 is provided between the front end side of the feed pipe 382 and the feed pump 387.

Note that, also in the embodiment, like the coal deactivation processing apparatuses 100, 200 of the aforementioned embodiments, the coal deactivation processing apparatus includes the members 121 to 133, 141 to 153, 161 to 166 which allow feeding of the processing gas 5. However, illustration of these members is omitted in FIG. 3 to avoid complication of the drawing.

Moreover, the sensors 161, 162, 165, 166 and the flow meters 163, 164, 367, 368 are electrically connected to an input unit of a control device 360 which is control means. An output unit of the control device 360 is electrically connected to the flow-rate adjustment valves 127, 128, 147, 148, 376, 386, the blowers 129, 149, the humidifying heating device 130, 150, the temperature controllers 375, 385, and the feed pumps 377, 387. The control device 360 can control operations of the flow-rate adjustment valves 127, 128, 147, 148, 376, 386, the blowers 129, 149, the humidifying heating device 130, 150, the temperature controllers 375, 385, and the feed pumps 377, 387 on the basis of information from the sensors 161, 162, 165, 166, the flow meters 163, 164, 367, 368, and the like (details will be described later).

Note that, in the embodiment, one-side flow means is formed of the cooling pipes 371, the feed pipe 372, the circulation pipe 373, the cooling water tank 374, the temperature controller 375, the flow-rate adjustment valve 376, the feed pump 377, and the like; other-side flow means is formed of the cooling pipes 381, the feed pipe 382, the circulation pipe 383, the cooling water tank 384, the temperature controller 385, the flow-rate adjustment valve 386, the feed pump 387, and the like; cooling water flow means is formed of the one-side flow means, the other-side flow means, and the like; and the apparatus main body internal-environment adjusting means is formed of the apparatus main body internal-temperature measuring means, the cooling water flow means, the control device 360, and the like.

In a coal deactivation processing apparatus 300 of such an embodiment, when the control device 360 is made to operate, the control device 360 operates in a similar way to the control devices 160, 260 in the coal deactivation processing apparatuses 100, 200 of the aforementioned embodiments and performs deactivation processing of the surface of the coal 1 in the processing tower 111.

Moreover, the control device 360 performs control of the temperature controller 375 along with the aforementioned deactivation processing in such a way that the cooling water 7 in the cooling water tank 374 is set to a predetermined temperature.

Then, when the amount of reaction between the coal 1 and the oxygen in the processing gas 5 per unit time is large and the temperature inside the processing tower 111 exceeds 95° C., the control device 360 controls the opening degrees of the flow-rate adjustment valves 376, 386 and the delivery forces of the feed pumps 377, 387 on the basis of information from the temperature sensors 165, 166 and the flow meters 367, 368, in such a way that the temperature inside the processing tower 111 becomes 95° C. or less. The control device 360 thereby causes the cooling water 7 to flow through the cooling pipes 371 while adjusting the flow rate of the cooling water 7 flowing from the cooling water tank 374 to the feed pipe 372 and thus cools the inside of the processing tower 111 with water.

In other words, although, in the aforementioned second embodiment, the temperature increase is suppressed by increasing the flow rate of the processing gas 5 flowing inside the processing tower 111 to cool the inside of the processing tower 111 with a wind, in the embodiment, the temperature increase is suppressed by causing the cooling water 7 to flow inside the processing tower 111 to cool the inside of the processing tower 111 with water.

Accordingly, in the coal deactivation processing apparatus 300 of the embodiment, effects similar to those in the aforementioned embodiments can be obtained.

Note that, as described in the aforementioned embodiment, the amount of reaction between the coal 1 and the oxygen in the processing gas 5 per unit time becomes large mostly when the coal 1 is first supplied into the processing tower 111. Moreover, the case where the amount of reaction is large is likely to occur in the upper 30% to 70% (50±20%) portion of the processing tower 111, and does not occur often in the lower 30% to 70% (50±20%) portion of the processing tower 111.

Accordingly, in the coal deactivation processing apparatus 300 of the embodiment, the initial cost and the running cost can be reduced by, for example, omitting the members 368, 381 to 387 together with the nitrogen supply pipe 125, the nitrogen supply source 126, the flow-rate adjustment valve 128, the oxygen sensor 161, and the like and supplying only the air 3 as the processing gas 5 at a fixed flow rate, without cooling the portion of the processing tower 111 below the middle thereof with the cooling water 7.

<Other Embodiments>

Note that, in the embodiments described above, the temperature inside the processing tower 111 is measured by providing the temperature sensors 165, 166 on the base end sides of the circulation pipes 131, 151 and thereby measuring the temperature of the used processing gas 6 exhausted from the processing tower 111. However, as another embodiment, for example, the temperature inside the processing tower 111 can be measured by providing a temperature sensor on a wall surface or in the inside of the processing tower 111.

Moreover, the embodiments described above can be carried out by being combined as appropriate.

INDUSTRIAL APPLICABILITY

Since the coal deactivation processing apparatus of the present invention can suppress the temperature increase of coal being processed, the coal deactivation processing apparatus can be very useful in industries.

REFERENCE SIGNS LIST

1, 2 COAL
3 AIR
4 NITROGEN GAS
5, 6 PROCESSING GAS
7 COOLING WATER
100 COAL DEACTIVATION PROCESSING APPARATUS
111 PROCESSING TOWER
112 SUPPLY CHAMBER
113 COOLING CHAMBER
121, 141 INTRODUCTION PIPE
122, 142 EXHAUST PIPE
123, 143 FEED PIPE
124, 144 AIR SUPPLY PIPE
125, 145 NITROGEN SUPPLY PIPE
126, 146 NITROGEN SUPPLY SOURCE
127, 128, 147, 148 FLOW-RATE ADJUSTMENT VALVE
129, 149 BLOWER
130, 150 HUMIDIFYING HEATING DEVICE
131, 151 CIRCULATION PIPE
132, 152 DUST REMOVING DEVICE
133, 153 EMISSION PIPE
160 CONTROL DEVICE
161, 162 OXYGEN SENSOR
163, 164 FLOW METER
165, 166 TEMPERATURE SENSOR
200 COAL DEACTIVATION PROCESSING APPARATUS
260 CONTROL DEVICE
300 COAL DEACTIVATION PROCESSING APPARATUS
367, 368 FLOW METER
371, 381 COOLING PIPE
372, 382 FEED PIPE
373, 383 CIRCULATION PIPE
374, 384 COOLING WATER TANK
375, 385 TEMPERATURE CONTROLLER
376, 386 FLOW-RATE ADJUSTMENT VALVE
377, 387 FEED PUMP

The invention claimed is:

1. A coal deactivation processing apparatus configured to deactivate coal with a processing gas containing oxygen, comprising:

an apparatus main body in which the coal flows from one side to another side;

processing gas feeding means for feeding the processing gas into the apparatus main body;

processing gas humidifying heating means for heating and humidifying the processing gas to be fed into the apparatus main body in such a way that a relative humidity of the processing gas is maintainable to be 35% or more even when a temperature of the processing gas is 95° C.; and apparatus main body internal-environment adjusting means for adjusting a temperature inside the apparatus main body in such a way that the relative humidity inside the apparatus main body is 35% or more and the temperature inside the apparatus main body is 95° C. or less.

2. The coal deactivation processing apparatus according to claim 1, wherein in the apparatus main body internal-environment adjusting means includes:

apparatus main body internal-temperature measuring means for measuring the temperature inside the apparatus main body;

processing gas oxygen concentration adjusting means for adjusting an oxygen concentration of the processing gas to be fed into the apparatus main body; and control means for controlling the processing gas oxygen concentration adjusting means on the basis of information from the apparatus main body internal-temperature measuring means.

3. The coal deactivation processing apparatus according to claim 2, wherein the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the processing gas oxygen concentration adjusting means includes one-side oxygen concentration adjusting means for adjusting the oxygen concentration of the processing gas to be fed into the one side of the apparatus main body, and the control means controls the one-side oxygen concentration adjusting means on the basis of information from the one-side temperature measuring means.

4. The coal deactivation processing apparatus according to claim 1, wherein the apparatus main body internal-environment adjusting means includes:

apparatus main body internal-temperature measuring means for measuring the temperature inside the apparatus main body;

processing gas flow-rate adjusting means for adjusting a flow rate of the processing gas to be fed into the apparatus main body; and control means for controlling the processing gas flow-rate adjusting means on the basis of information from the apparatus main body internal-temperature measuring means.

5. The coal deactivation processing apparatus according to claim 4, wherein the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the processing gas flow-rate adjusting means includes one-side gas flow-rate adjusting means for adjusting the flow-rate of the processing gas to be fed into the one side of the apparatus main body, and the control means controls the one-side gas flow-rate adjusting means on the basis of information from the one-side temperature measuring means.

6. The coal deactivation processing apparatus according to claim 1, wherein the apparatus main body internal-environment adjusting means includes:

apparatus main body internal-temperature measuring means for measuring the temperature inside the apparatus main body;

cooling water flow means for causing cooling water to flow inside the apparatus main body; and control means for controlling the cooling water flow means on the basis of information from the apparatus main body internal-temperature measuring means.

7. The coal deactivation processing apparatus according to claim 6, wherein the processing gas feeding means includes: one-side feeding means for feeding the processing gas into the one side of the apparatus main body; and other-side feeding means for feeding the processing gas into the other side of the apparatus main body, the processing gas humidifying heating means includes: one-side humidifying heating means for heating and humidifying the processing gas to be fed into the one side of the apparatus main body in such a way that the relative humidity of the processing gas is maintainable to be 35% or more even when the temperature of the processing gas is 95° C.; and other-side humidifying heating means for heating and humidifying the processing gas to be fed into the other side of the apparatus main body in such a way that the relative humidity of the processing gas is maintainable to be 35% or more even when the temperature of the processing gas is 95° C., the apparatus main body internal-temperature measuring means includes one-side temperature measuring means for measuring a temperature inside the apparatus main body on the one side, the cooling water flow means includes one-side flow means for causing the cooling water to flow inside the apparatus main body on the one side, and the control means controls the one-side flow means on the basis of information from the one-side temperature measuring means.

* * * * *